US005469722A

United States Patent [19]

Ellefsen

[11] Patent Number: 5,469,722

[45] Date of Patent: Nov. 28, 1995

[54] HASP FOR A CYLINDER LOCK

[76] Inventor: Robert J. Ellefsen, 4519 E. Wonderlake Dr., Wonderlake, Ill. 60097

[21] Appl. No.: 83,034

[22] Filed: Jun. 24, 1993

[51] Int. Cl.[6] ..... E05B 65/48; E05B 67/36

[52] U.S. Cl. ..... 70/56; 70/34; 70/417; 70/2

[58] Field of Search ..... 70/2–14, 23, 32–34, 70/51, 52, 54–56, 416, 417; 292/148, 150, 151, 281

[56] References Cited

U.S. PATENT DOCUMENTS

| | | | |
|---|---|---|---|
| 957,803 | 5/1910 | Schmidt | 70/32 X |
| 2,193,368 | 3/1940 | Harrison | 70/32 |
| 3,158,908 | 12/1964 | Springer | 292/67 X |
| 3,769,821 | 11/1973 | Randel | 70/33 |
| 3,817,062 | 6/1974 | Randel | 70/11 |
| 3,852,981 | 12/1974 | Koning | 70/2 |
| 3,996,774 | 12/1976 | Best | 70/32 |
| 4,345,448 | 8/1982 | Solomon | 70/95 |
| 4,751,831 | 6/1988 | Morris, Jr. et al. | 70/34 X |
| 4,754,626 | 7/1988 | Siegel | 70/32 |
| 4,866,960 | 9/1989 | Brower | 70/417 X |
| 5,026,100 | 6/1991 | Hulkenberg, Jr. | 292/DIG. 71 X |
| 5,035,127 | 7/1991 | Larsen | 70/417 X |
| 5,127,244 | 7/1992 | Myers | 70/2 |
| 5,172,574 | 12/1992 | Perfetto | 70/56 |

FOREIGN PATENT DOCUMENTS

| | | | |
|---|---|---|---|
| 83-01645 | 5/1983 | WIPO | 70/2 |

*Primary Examiner*—Peter M. Cuomo
*Assistant Examiner*—Suzanne L. Dino
*Attorney, Agent, or Firm*—Charles F. Meroni, Jr.; Robert P. Toczycki

[57] ABSTRACT

A locking device which includes a new combination of components, namely, the hasp and a round cylinder lock protectively embedded in an indentation built into the hasp. The hasp is designed to be used with a round cylinder lock of the type disclosed in U.S. Pat. No. 3,769,821 and sold by the American Lock Company. The hasp of the present invention is comprised of a steel reinforced plate, the steel reinforced plate has a truncated circular indentation on a front side thereof for encapsulating an outer diameter of the round cylinder lock. The truncated circular indentation has a hasp hole, a locking pin extends from the round cylinder lock and is receivable in the hasp hole. The hasp hole is sized slightly larger than the outer circumference of the locking pin, the locking pin is fixed to the round cylinder lock and extends axially outwardly thereof. A plate lug is supported on the steel reinforced plate and projects axially outwardly of the truncated circular indentation for telescoping engagement internally of the round cylinder lock, the plate lug has a plate lug hole extending at right angles to the plate lug. A sliding tubular lock shaft is located within the round cylinder lock, the plate lug is extendible into the round cylinder lock for receipt of the sliding tubular lock shaft within the plate lug hole, thereby enabling the plate lug and the hasp to be secured in locked assembly with the round cylinder lock.

21 Claims, 3 Drawing Sheets

FIG. 5
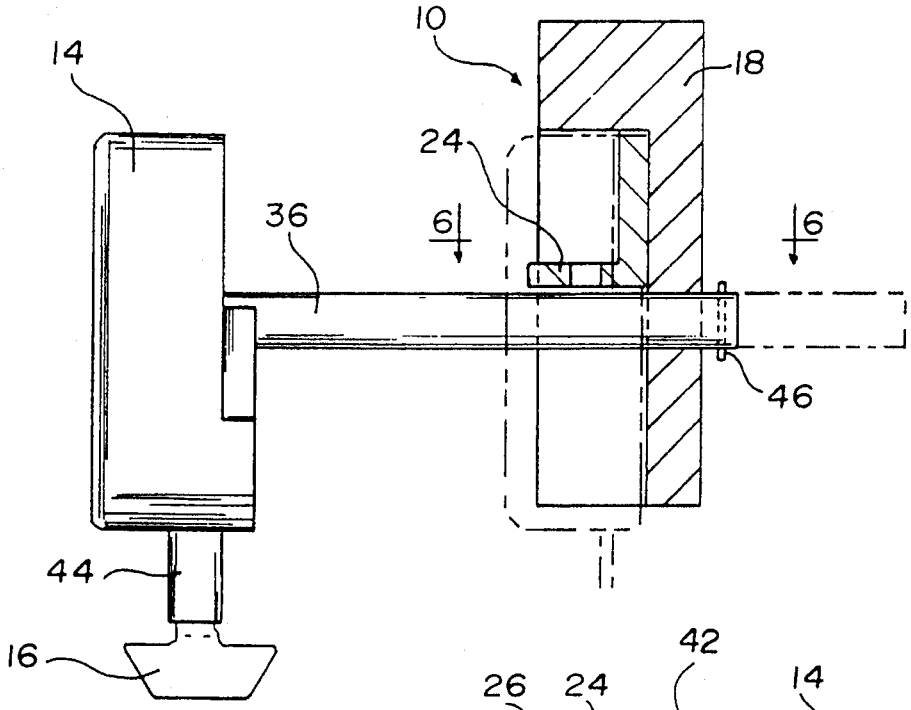
FIG. 6
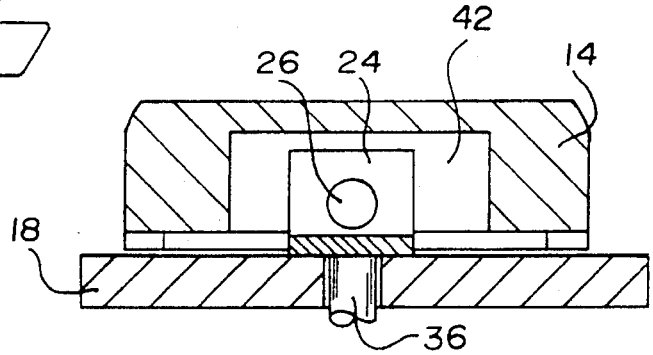
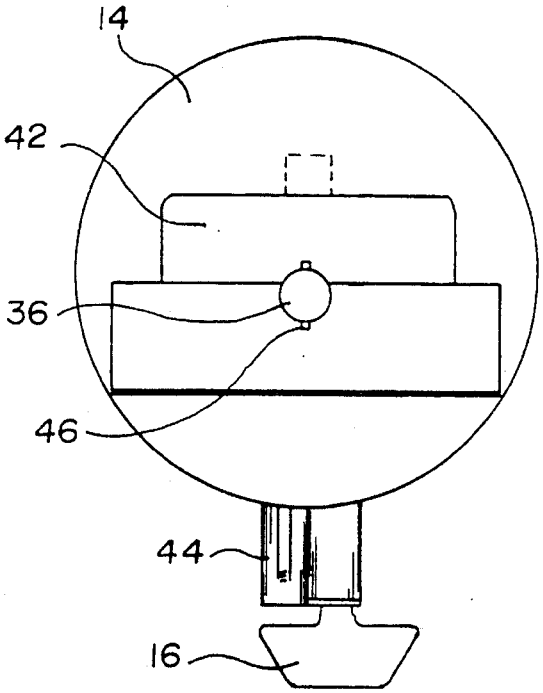
FIG. 7
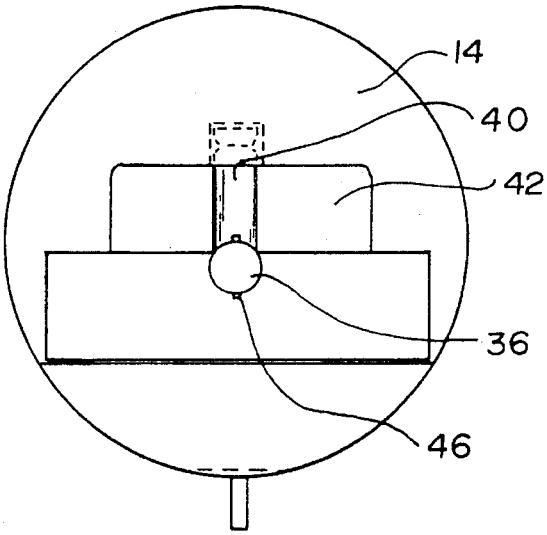
FIG. 8

HASP FOR A CYLINDER LOCK

BACKGROUND OF THE INVENTION

The present invention relates to a locking device, a new and improved hasp, and more specifically to a locking device which includes a new combination of components, namely, the hasp and a round cylinder lock protectively embedded in an indentation built into the hasp. The hasp is designed to be used with a round cylinder lock of the type disclosed in U.S. Pat. No. 3,769,821 and sold by the American Lock Company. This invention is able to provide a highly versatile locking system for use in a number of different structures such as sliding doors on the backs of trucks, on store fronts, on garage doors, on warehouses, and the like. This locking device makes it more difficult for burglars to penetrate since there is no easy way to cut the lock open or to pry the lock from the uniquely constructed hasp. In my invention, I have provided a hasp for a round cylinder lock. The hasp is comprised of a steel reinforced plate. The steel reinforced plate has a truncated circular indentation on a front side thereof for encapsulating an outer diameter of the round cylinder lock. The truncated circular indentation also has a hasp hole. A locking pin extends from the round cylinder lock and the pin is receivable in the hasp hole. The hasp hole is sized slightly larger than the outer circumference of the locking pin. The locking pin is fixed to the round cylinder lock and extends axially outwardly thereof. A plate lug is supported on the steel reinforced plate and projects axially outwardly of the truncated circular indentation for telescoping engagement internally of the round cylinder lock. The plate lug has a plate lug hole extending at right angles to the plate lug. A sliding tubular lock shaft is located within the round cylinder lock. The plate lug is extendible into the round cylinder lock for receipt of the sliding tubular lock shaft within the plate lug hole, thereby enabling the plate lug and the hasp to be secured in locked assembly with the cylinder lock.

DESCRIPTION OF THE PRIOR ART

The locking devices commonly used on truck doors, garages, store fronts, warehouses and the like are of the common padlock type variety. Many attempts have been made to make a low cost locking mechanism resistant to burglars. Most of these locking devices can typically be broken into using a crow bar, cutting tools, bolt cutters, chisels and the like and do not provide adequate protection. Most of these locking devices are not always easy to secure into place and have not become commercially successful.

For example, Best in U.S. Pat. No. 3,996,774 discloses a high security locking mechanism in which the lock and the hasp and keeper assembly interact to give high security. The lock encloses and closely embraces the eyes of the hasp and keeper and lies close against the pads of the hasp and keeper. Shroud plates overlying the pads closely surround the rear edge of the lock. The shrouds and plates of the hasp meet those of the keeper at a separation plane offset from that of the eyes and of the door and its jamb.

Also Siegel in U.S. Pat. No. 4,754,626 discloses a shackleless lock protector that is designed to be received over a padlock strap and staple combination used to lock a door. It consists of an elongated block or bar having an opening for receiving the padlock staple, and a larger opening in a face of the block receives a flat cylindrical lock member that also receives the padlock staple and locks the door by the employment of a key to advance the lock member bolt through the staple.

These locking devices utilize a cylindrical lock, however they can be pried open using a crow bar and also are not adequate to provide a locking mechanism for a movable wall member to a fixed wall member.

Other locking devices that are used to lock a movable wall member to a fixed wall member involve a removable pin that is inserted into the hasp and must also enter a hole in the back plate of the hasp to create a locking action, then the cylinder lock is placed on top of the pin to lock the pin to a fixed staple.

For example Solomon in U.S. Pat. No. 4,345,448 discloses a locking assembly for normally separable apertured structures which protect business fronts against burglary. The locking assembly includes a sturdy, straight pin which penetrates all apertures, and is part of a sturdy bracket which overlies a fixed standard or post. This device is intended to be locked with a cylindrical lock.

Also Perfetto in U.S. Pat. No. 5,172,574 discloses a locking system utilizing a padlock guard which is designed specifically for use with a cylindrical lock. The lock has a flat-faced cylindrical housing and an internal key cylinder-operable bolt which can be selectively protracted through and retracted from a hasp staple or the like inserted into a channel in the housing which intersects the path of movement of the bolt.

In accordance with the present invention, the disadvantages over the prior art have been overcome by the provision of fixing the locking pin to the round cylinder lock and keeping the round cylinder lock, locking pin and hasp as a one piece assembly and also providing a hasp thick enough to protect the round cylinder lock from being pried off.

SUMMARY OF THE INVENTION

In accordance with my invention I have provided a hasp for a round cylinder lock, the hasp comprises a steel reinforced plate, the steel reinforced plate has a truncated circular indentation on a front side thereof for encapsulating an outer diameter of a round cylinder lock, the truncated circular indentation has a hasp hole, the hasp hole is positioned within the truncated circular indentation for receiving a locking pin carried on a round cylinder lock, the hasp hole is sized slightly larger than the outer circumference of the locking pin, a plate lug is supported on the steel reinforced plate and projects axially outwardly of the truncated circular indentation for telescoping engagement internally of a round cylinder lock, the plate lug has a plate lug hole extending at right angles to the plate lug, the plate lug hole is positioned for receiving a sliding tubular lock shaft carried on a round cylinder lock, the plate lug is extendible into the round cylinder lock for receipt of the sliding tubular lock shaft within the plate lug hole, thereby enabling the plate lug and the hasp to be secured in locked assembly with the round cylinder lock.

Other features of my invention relate to a hasp similar to the hasp described above wherein the plate lug is cast in said truncated circular indentation with the steel reinforced plate as a one piece unit.

Further features of my invention relate to a hasp similar to the hasp described above wherein the steel reinforced plate has a back side, the back side has four corner threaded holes for receipt of fasteners for securement of the steel reinforced plate to a supporting structure.

Yet other features of my invention relate to a hasp similar to the hasp described above wherein the truncated circular indentation has an opening on the bottom of the steel reinforced plate in alignment with the plate lug hole, the opening is provided for enabling a movable key cylinder from a round cylinder lock to be moved with the sliding tubular lock shaft into and out of engagement with the plate lug hole.

Another feature of my invention relates to a locking mechanism for securing a sliding door to a door jam for use with a round cylinder type lock, the improvement comprises a hasp and the round cylinder lock, the hasp comprising a steel reinforced plate, the steel reinforced plate has a truncated circular indentation on a front side thereof for encapsulating an outer diameter of the round cylinder lock, the truncated circular indentation has a hasp hole, a locking pin extends from the round cylinder lock and is receivable in the hasp hole, the hasp hole is sized slightly larger than the outer circumference of the locking pin, the locking pin is fixed to the round cylinder lock and extends axially outwardly thereof, a plate lug is supported on the steel reinforced plate and projects axially outwardly of the truncated circular indentation for telescoping engagement internally of the round cylinder lock, the plate lug has a plate lug hole extending at right angles to the plate lug, a sliding tubular lock shaft is located within the round cylinder lock, the plate lug is extendible into the round cylinder lock for receipt of the sliding tubular lock shaft within the plate lug hole, thereby enabling the plate lug and the hasp to be secured in locked assembly with the cylinder lock.

Yet another feature of my invention relates to the combination of a hasp and a round cylinder lock, the hasp comprises a steel reinforced plate, the steel reinforced plate has a truncated circular indentation on a front side thereof for encapsulating an outer diameter of the round cylinder lock, the truncated circular indentation has a hasp hole, a locking pin extends from the round cylinder lock and is receivable in the hasp hole, the hasp hole is sized slightly larger than the outer circumference of the locking pin, the locking pin is fixed to the round cylinder lock and extends axially outwardly thereof, a plate lug is supported on the steel reinforced plate and projects axially outwardly of the truncated circular indentation for telescoping engagement internally of the round cylinder lock, the plate lug has a plate lug hole extending at right angles to the plate lug, a sliding tubular lock shaft is located within the round cylinder lock, the plate lug is extendible into the round cylinder lock for receipt of the sliding tubular lock shaft within the plate lug hole, thereby enabling the plate lug and the hasp to be secured in locked assembly with the cylinder lock.

Still further features of my invention relate to a hasp and a lock similar to the one described above wherein a retaining device is located at the free end of the locking pin, the retaining device acts to prevent the locking pin from sliding out of the hasp hole and being inseparable from the hasp thereby making it easier to push the round cylinder lock into position for locking.

Still other features of my invention relate to a hasp and a lock similar to the one described above wherein the locking pin is square in shape and the hasp hole is also square in shape, the hasp hole is slightly larger than the outer circumference of the locking pin, wherein when the round cylinder lock is pulled from the hasp, the round cylinder lock does not rotate about the hasp and the round cylinder lock can be quickly pressed onto the hasp and engage the plate lug without twisting the round cylinder lock to fit the plate lug.

BRIEF DESCRIPTION OF THE DRAWINGS

FIG. 5 is a fragmentary partially sectioned side view of the lock assembly showing the position of the lock on and off of the hasp;

FIG. 6 is an enlarged fragmentary vertical section as appearing on the line "6"—"6" looking in the direction indicated by the arrows as seen in FIG. 5;

FIG. 7 is a fragmentary back view of the lock and locking pin without the hasp showing the lock in unlocked position; and FIG. 8 is a fragmentary back view of the lock and locking pin without the hasp showing the lock in locked position.

DESCRIPTION OF THE PREFERRED EMBODIMENT

Figure 1:
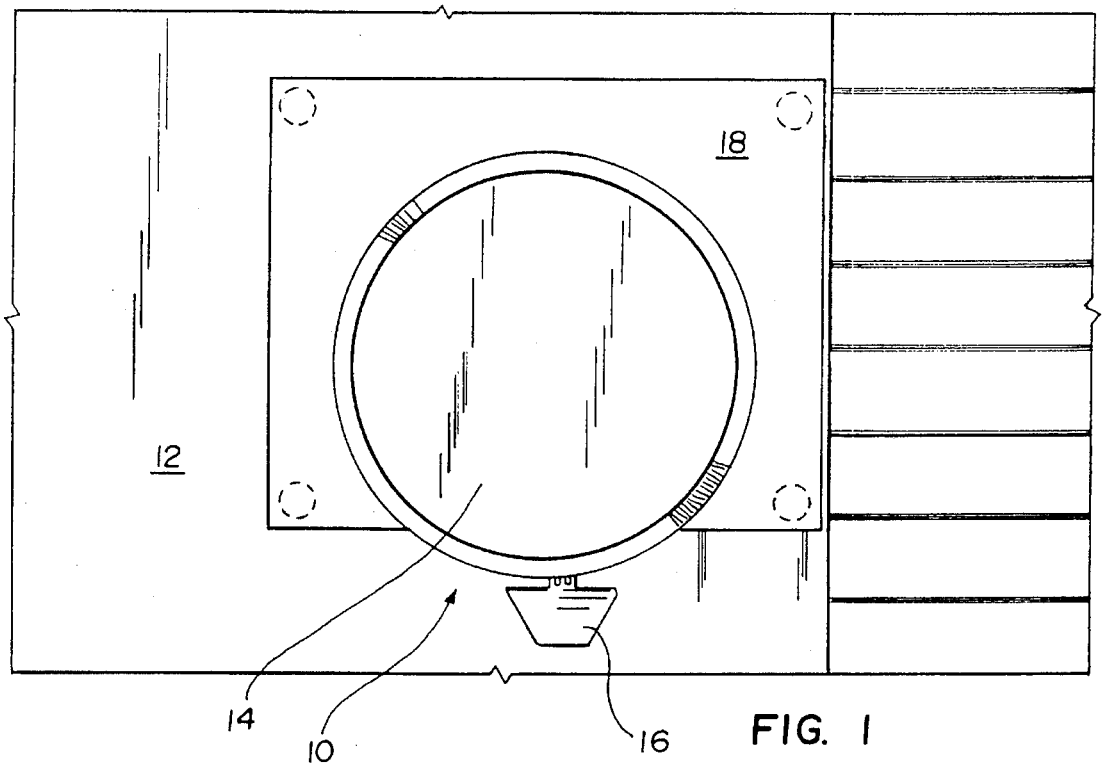
FIG. 1 is a from view of the lock assembly on the jamb of a truck door.
Figure 2:
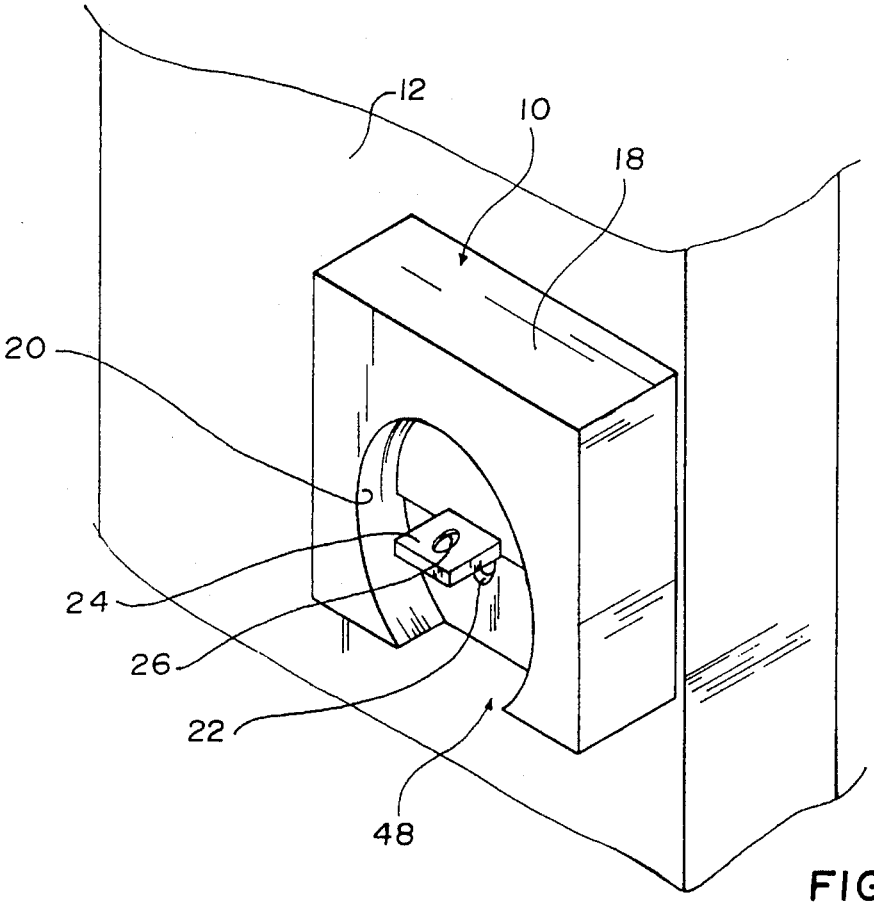
FIG. 2 is a perspective view of the hasp only without the lock on a door jamb.
Figure 3:
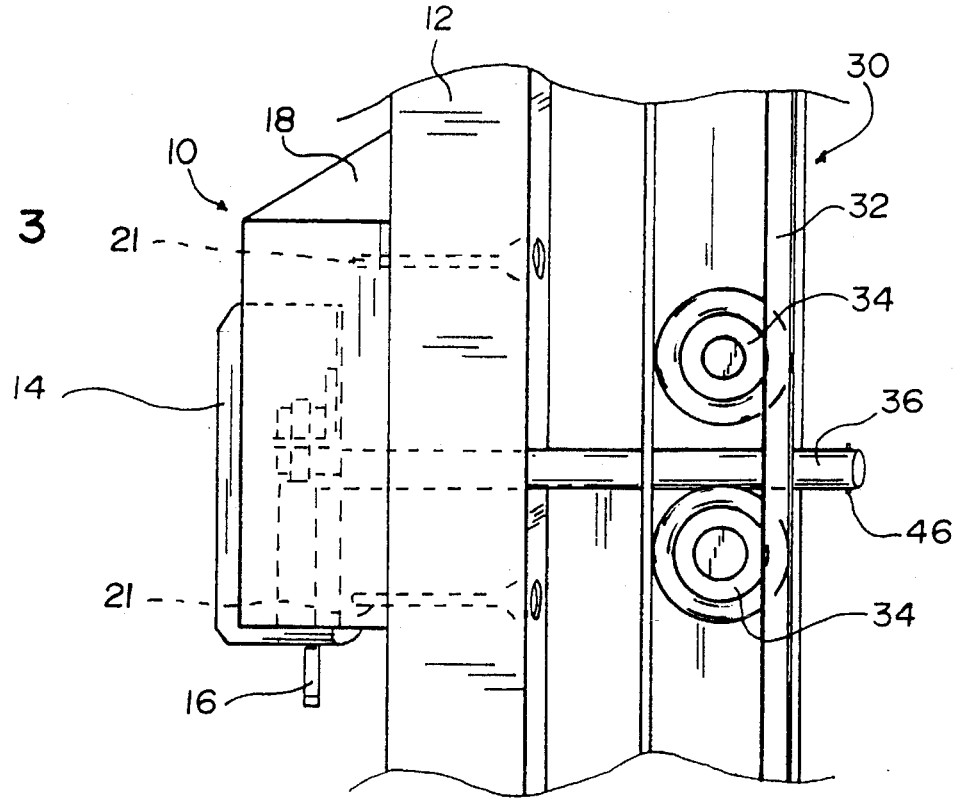
FIG. 3 is a diagrammatic view of the lock assembly in locked position showing the locking pin engaged through the hasp and the roller track with portions of the cylinder lock indicated by dotted lines.
Figure 4:
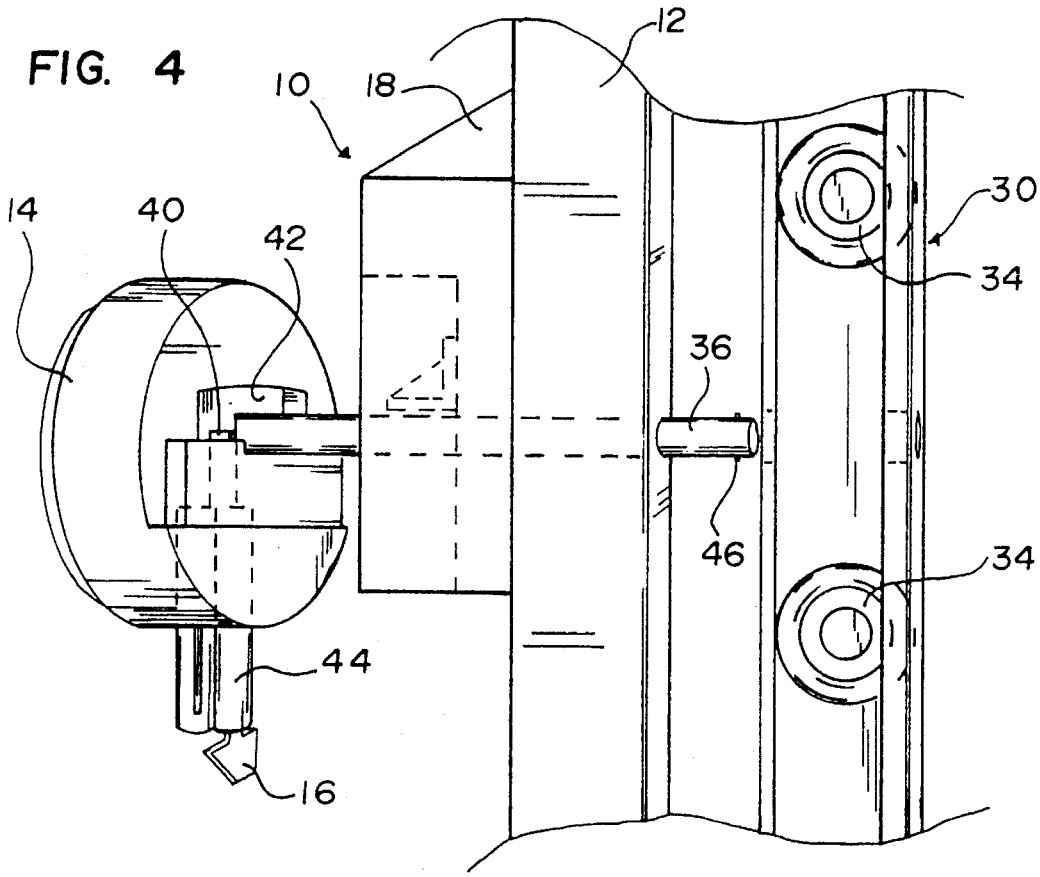
FIG. 4 is a diagrammatic view of FIG. 3 showing the lock assembly in unlocked position allowing the door with the lock assembly to move up and/or down with portions of the cylinder lock indicated by dotted lines.

Referring now to the drawings in FIG. 1, the hasp 10 is mounted on a movable wall structure 12 and is locked by a round cylinder lock 14 by a key 16. The round cylinder lock 14 has a cylindrical housing.

Referring to FIGS. 2–8, the hasp comprises a steel reinforced plate 18. The steel reinforced plate has a truncated circular indentation 20 on a front side thereof for encapsulating an outer diameter of the round cylinder lock 14. The hasp 10 is secured to the movable wall structure 12 by screws 21, or the hasp can be secured to the movable wall structure by welding the hasp onto the wall. The truncated circular indentation 20 has a depth equivalent to the axial thickness of the round cylinder lock 14, providing a shield for the round cylinder lock to protect it from being pried off. The truncated circular indentation 20 has a hasp hole 22. The hasp hole 22 is positioned within the truncated circular indentation 20. A plate lug 24 is supported on the steel reinforced plate 18 and projects axially outwardly of the truncated circular indentation 20 for telescoping engagement internally of the round cylinder lock 14. The plate lug 24 has a plate lug hole 26 extending at right angles to the plate lug.

A fixed wall structure 30 is positioned on the opposite side of the movable wall structure 12. The fixed wall structure 30 comprises a guard rail 32 with wheels 34 so the movable wall structure 12 can be locked at any height level by inserting a locking pin 36 between any of the wheels located on the guard rail. The locking pin 36 is fixed to the round cylinder lock 14 and extends axially outwardly thereof. The wheels 34 on the guard rail 32 are fixed to the guard rail and the wheels are free to rotate and to provide a mechanism for moving the movable wall structure 12 up and down. The fixed wall structure 30 can also consist of a back plate having a hole for receipt of the locking pin 36.

A sliding tubular lock shaft 40 is located within the round cylinder lock 14. The plate lug 24 is extendible into the round cylinder lock 14 for receipt of the sliding tubular lock shaft 40. The sliding tubular lock shaft is engageable with the plate lug 24. The cylindrical housing of the round cylinder lock 14 has an opening 42 for insertion of the plate lug 24. The sliding tubular lock shaft 40 is mounted within the cylindrical housing and is capable of extending through the opening 42 to engage the plate lug 24. A movable key cylinder 44 is fixedly mounted within cylindrical housing. The movable key cylinder 44 has an interior locking mechanism to lock the round cylinder lock 14 onto the hasp 10 and engage the plate lug 24.

The truncated circular indentation 20 has an opening 48 on the bottom of the steel reinforced plate 18 in alignment with the plate lug hole 26. The opening 48 is provided for enabling the movable key cylinder 44 from the round cylinder lock 14 to be moved with the sliding tubular lock shaft 40 into and out of engagement with the plate lug hole 26.

A pin 46 is mounted on the free end of the locking pin 36. The pin 46 acts to prevent the locking pin 36 from sliding out of the hasp hole 22 and being inseparable from the hasp thereby making it easier to push the round cylinder lock 14 into position.

As various possible embodiments may be made in the above invention for use for different purposes and as various changes might be made in the embodiments and method above set fort, it is understood that all of the above matters here set forth or shown in the accompanying drawings are to be interpreted as illustrative and not in a limiting sense.

I claim:

1. A hasp for a round cylinder lock, the hasp comprising a steel reinforced plate, the steel reinforced plate having a truncated circular indentation on a front side thereof for encapsulating an outer diameter of a round cylinder lock, said truncated circular indentation having a depth generally equivalent to an axial thickness of the round cylinder lock, said truncated circular indentation having a hasp hole, the hasp hole being positioned within the truncated circular indentation for receiving a locking pin that extends from a round cylinder lock, said locking pin being fixed to the round cylinder lock even when the round cylinder lock is in an unlocked position, said hasp hole being sized slightly larger than an outer circumference of the locking pin, a plate lug supported on the steel reinforced plate and projecting axially outwardly of the truncated circular indentation for telescoping engagement internally of the round cylinder lock, the plate lug having a plate lug hole extending generally at right angles to the plate lug, the plate lug hole being positioned for receiving a sliding tubular lock shaft carried on the round cylinder lock, said plate lug being extendible into the round cylinder lock for receipt of the sliding tubular lock shaft within the plate lug hole, thereby enabling the plate lug and the hasp to be secured in locked assembly with the round cylinder lock.

2. The hasp of claim 1, wherein the plate lug is cast in said truncated circular indentation with the steel reinforced plate as a one piece unit.

3. The hasp of claim 1, wherein the steel reinforced plate has a back side, the back side having four corner threaded holes for receipt of fasteners for securement of the steel reinforced plate to a supporting structure.

4. The hasp of claim 1, wherein the truncated circular indentation has an opening on the bottom of the steel reinforced plate in alignment with the plate lug hole, the opening being provided for enabling a movable key cylinder from a round cylinder lock to be moved with the sliding tubular lock shaft into and out of engagement with the plate lug hole.

5. In a locking mechanism for securing a sliding door to a door jam for use with a round cylinder type lock, the improvement comprising a hasp and the round cylinder lock, the hasp comprising a steel reinforced plate, the steel reinforced plate having a truncated circular indentation on a front side thereof for encapsulating an outer diameter of the round cylinder lock, said truncated circular indentation having a depth generally equivalent to an axial thickness of the round cylinder lock, said truncated circular indentation having a hasp hole, a locking pin extending from the round cylinder lock is receivable in the hasp hole, said hasp hole being sized slightly larger than an outer circumference of the locking pin, said locking pin being fixed to the round cylinder lock and extending axially outwardly thereof, said locking pin being fixed to the round cylinder lock even when the round cylinder lock is in an unlocked position, a plate lug supported on the steel reinforced plate and projecting axially outwardly of the truncated circular indentation for telescoping engagement internally of the round cylinder lock, the plate lug having a plate lug hole extending generally at right angles to the plate lug, a sliding tubular lock shaft is located within the round cylinder lock, said plate lug being extendible into the round cylinder lock for receipt of the sliding tubular lock shaft within the plate lug hole, thereby enabling the plate lug and the hasp to be secured in locked assembly with the round cylinder lock.

6. The locking mechanism of claim 5, wherein the plate lug is cast in said indentation with the plate as a one piece unit.

7. The locking mechanism of claim 5, wherein the steel reinforced plate has a back side, the back side having four corner threaded holes for receipt of fasteners for securement of the steel reinforced plate to a supporting structure.

8. The locking mechanism of claim 5, wherein a retaining means is located at the free end of the locking pin, said retaining means acting to prevent the locking pin from sliding out of the hasp hole and being inseparable from the hasp thereby making it easier to push the round cylinder lock into position for locking.

9. The locking mechanism of claim 5, wherein the truncated circular indentation has an opening on the bottom of the steel reinforced plate in alignment with the plate lug hole, the opening being provided for enabling a movable key cylinder from a round cylinder lock to be moved with the sliding tubular lock shaft into and out of engagement with the plate lug hole.

10. In combination, a hasp and a round cylinder lock, the hasp comprising comprising a steel reinforced plate, the steel reinforced plate having a truncated circular indentation on a front side thereof for encapsulating an outer diameter of the round cylinder lock, said truncated circular indentation having a depth generally equivalent to an axial thickness of the round cylinder lock, said truncated circular indentation having a hasp hole, a locking pin extending from the round cylinder lock is receivable in the hasp hole, said hasp hole being sized slightly larger than an outer circumference of the locking pin, said locking pin being fixed to the round cylinder lock and extending axially outwardly thereof, said locking pin being fixed to the round cylinder lock even when the round cylinder lock is in an unlocked position, a plate lug supported on the steel reinforced plate and projecting axially outwardly of the truncated circular indentation for telescoping engagement internally of the round cylinder lock, the plate lug having a plate lug hole extending generally at right angles to the plate lug, a sliding tubular lock shaft is located within the round cylinder lock, said plate lug being extendible into the round cylinder lock for receipt of the sliding tubular lock shaft within the plate lug hole, thereby enabling the plate lug and the hasp to be secured in locked assembly with the round cylinder lock.

11. The combination of claim 10, wherein the plate lug is cast with the plate in said indentation as a one piece unit.

12. The combination of claim 10, wherein the steel reinforced plate has a back side, the back side having four corner threaded holes for receipt of fasteners for securement of the steel reinforced plate to a supporting structure.

13. The combination of claim 10, wherein a retaining means is located at the free end of the locking pin, said retaining means acting to prevent the locking pin from sliding out of the hasp hole and being inseparable from the hasp thereby making it easier to push the round cylinder lock into position for locking.

14. The combination of claim 10, wherein the truncated circular indentation has an opening on the bottom of the steel reinforced plate in alignment with the plate lug hole, the opening being provided for enabling a movable key cylinder from a round cylinder lock to be moved with the sliding tubular lock shaft into and out of engagement with the plate lug hole.

15. A hasp for a padlock, the hasp comprising a steel reinforced plate, the steel reinforced plate having an indentation on a front side thereof for encapsulating an outer dimension of a padlock, said indentation having a depth generally equivalent to an axial thickness of the padlock, said indentation having a hasp hole, the hasp hole being positioned within the indentation for receiving a locking pin that extends from a padlock, said locking pin being fixed to the padlock even when the padlock is in an unlocked position, said hasp hole being sized slightly larger than an outer circumference of the locking pin, a plate lug supported on the steel reinforced plate and projecting axially outwardly of the indentation for telescoping engagement internally of the padlock, the plate lug having a plate lug hole extending generally at right angles to the plate lug, the plate lug hole being positioned for receiving a sliding tubular lock shaft carried on the padlock, said plate lug being extendible into the padlock for receipt of the sliding tubular lock shaft within the plate lug hole, thereby enabling the plate lug and the hasp to be secured in locked assembly with the padlock.

16. The hasp of claim 15, wherein the plate lug is cast in said indentation with the steel reinforced plate as a one piece unit.

17. The hasp of claim 15, wherein the steel reinforced plate has a back side, the back side having four corner threaded holes for receipt of fasteners for securement of the steel reinforced plate to a supporting structure.

18. The hasp of claim 15, wherein the indentation has an opening on the bottom of the steel reinforced plate in alignment with the plate lug hole, the opening being provided for enabling a movable key cylinder from a padlock to be moved with the sliding tubular lock shaft into and out of engagement with the plate lug hole.

19. In combination, a hasp and a padlock, the hasp comprising comprising a steel reinforced plate, the steel reinforced plate having an indentation on a front side thereof for encapsulating an outer dimension of the padlock, said indentation having a depth generally equivalent to an axial thickness of the padlock, said indentation having a hasp hole, a locking pin extending from the padlock is receivable in the hasp hole, said hasp hole being sized slightly larger than an outer circumference of the locking pin, said locking pin being fixed to the padlock and extending axially outwardly thereof, said locking pin being fixed to the padlock even when the padlock is in an unlocked position, a plate lug supported on the steel reinforced plate and projecting axially outwardly of the indentation for telescoping engagement internally of the padlock, the plate lug having a plate lug hole extending generally at right angles to the plate lug, a sliding tubular lock shaft is located within the padlock, said plate lug being extendible into the padlock for receipt of the sliding tubular lock shaft within the plate lug hole, thereby enabling the plate lug and the hasp to be secured in locked assembly with the padlock.

20. The combination of claim 19, wherein the steel reinforced plate has a back side, the back side having four corner threaded holes for receipt of fasteners for securement of the steel reinforced plate to a supporting structure.

21. The combination of claim 19, wherein a retaining means is located at the free end of the locking pin, said retaining means acting to prevent the locking pin from sliding out of the hasp hole and being inseparable from the hasp thereby making it easier to push the padlock into position for locking.

* * * * *